United States Patent [19]

Garrido et al.

[11] Patent Number: 4,977,983

[45] Date of Patent: Dec. 18, 1990

[54] MOUNT SYSTEM FOR ELEVATOR GUIDE RAILS

[75] Inventors: Alfonso Garrido; Jose Sevilleja; Julian Cabanas, all of Madrid, Spain

[73] Assignee: Otis Elevator Company, Farmington, Conn.

[21] Appl. No.: 427,055

[22] Filed: Oct. 26, 1989

[51] Int. Cl.[5] ..... B66B 7/02

[52] U.S. Cl. ..... 187/95; 187/1 R; 104/127; 52/30

[58] Field of Search ..... 52/30, 584, 699, 710, 52/721; 104/127, 124; 187/1 R, 83, 85, 86, 90, 95, 96

[56] References Cited

U.S. PATENT DOCUMENTS 849,188 4/1907 Bennett et al. ..... 187/85
3,313,376 4/1967 Holland ..... 187/95 X
3,601,356 8/1971 Yurick ..... 52/584 X

FOREIGN PATENT DOCUMENTS 403201 4/1966 Australia .

*Primary Examiner*—H. Grant Skaggs
*Assistant Examiner*—Dean A. Reichard
*Attorney, Agent, or Firm*—William W. Jones

[57] ABSTRACT

Guide rails for a cantilevered elevator are mounted in the elevator hoistway on structural components of the building. The mounting assembly provides for an increased number of guide rail securement points in the hoistway without the need for increasing the number of structural components directly built into the building. Increased resistance to lateral deflection of the guide rails is thus achieved without requiring heavier than normal guide rails.

3 Claims, 1 Drawing Sheet

MOUNT SYSTEM FOR ELEVATOR GUIDE RAILS

TECHNICAL FIELD

This invention relates to an improved mount assembly for mounting elevator guide rails in an elevator hoistway. More specifically, the mount assembly of this invention provides for a more stable guide rail securement without the addition of further structural building components.

BACKGROUND ART

Most modern multistory buildings worldwide are constructed with horizontal structural beams which are spaced apart a vertical distance of about three meters. The horizontal structural beams are typically used for anchoring the elevator guide rails in the building hoistways. To this end, steel beams will be fixed to the structural beams by brackets, and the guide rail mounting clip assemblies will be fastened to the steel beams. The guide rails will then be clipped to the clip assemblies. The brackets, steel beams and clip assembly plates are then all welded together.

The three meter vertical spacing of the building's structural beams can create problems relative to the lateral stiffness of the guide rails. These problems have been addressed in two ways. One solution to the problem of lateral guide rail flexure is to use heavier guide rails which are inherently more stiff. These guide rails are more costly, and are more difficult to install and support due to their increased weight. A more common solution to the problem has been to fasten intervening horizontal steel beams to the building structure midway between each of the normal building structural beams, and to use the intervening beams also to carry auxiliary steel support beams which have rail clip assemblies on them. The rail clips in the latter case will have a vertical spacing of 1.5 meters, and conventional guide rails can thus be used. The latter solution, however, also increases cost and delays elevator installation because of the additional structural beams which must be installed.

DISCLOSURE OF THE INVENTION

This invention relates to an improved mount assembly for elevator guide rails which provides increased resistance to rail flexure without the need for additional building structural beams while permitting the use of conventional guide rails. The mount assembly of this invention includes a basal beam member which is elongated vertically in the hoistway and which is attached to the horizontal structural beams. The basal beam thus extends upwardly and downwardly in the hoistway from the structural beams. Extension arms are fastened to opposite ends of the basal beam to extend along the walls of the hoistway away from the basal beam and the structural beam. The rail mounting clip assemblies are mounted on the ends of the extension arms. Thus for each horizontal structural beam in the hoistway, there are two vertically offset guide rail clip mounting assemblies, one above and one below the structural beam. Thus each gap of 3 meters between adjacent structural beams will contain two guide rail clip mounting assemblies so that the vertical distance between adjacent guide rail clip mounting assemblies is significantly less than the 3 meter distance between the horizontal structural beams. Once assembled, the entire mounting assembly can be welded together for increased rigidity. The use of this mounting system which provides two guide rail clip assemblies for each structural building beam allows the use of standard guide rails in the hoistway.

It is therefore an object of this invention to provide an improved elevator guide rail mounting system for use in reducing lateral flexure of guide rails in modern building structures.

It is an additional object of this invention to provide an elevator guide rail mounting system of the character described which provides additional rail clip assemblies without the need for additional structural members being connected to the hoistway walls.

It is a further object of this invention to provide an elevator guide rail mounting system of the character described which allows the use of standard guide rails.

These and other objects and advantages of this invention will become more readily apparent from the following detailed description of a preferred embodiment of the invention when taken in conjunction with the accompanying drawings, in which:

BEST MODE FOR CARRYING OUT THE INVENTION

Figure 1:
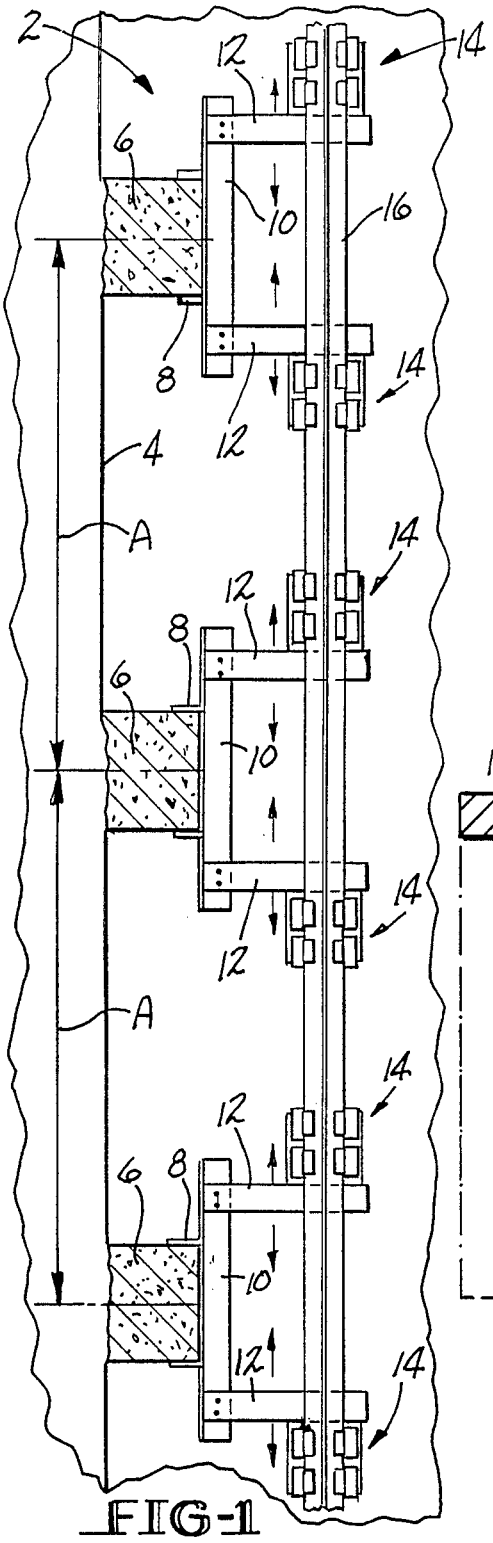
FIG. 1 is a fragmented elevational view of an elevator hoistway showing the guide rail mount assemblies of this invention mounted on the horizontal structural beams.

Referring now to the drawings, there is shown in FIG. 1 a portion of an elevator hoistway denoted generally by the numeral 2, which hoistway 2 has a back wall 4 which includes vertically spaced-apart horizontal structural beams 6 which form a part of the building itself. The vertical distance A between the mid plane of adjacent ones of the beams 6 is generally about 3 meters. Each of the beams 6 has a bracket 8 fastened thereto. A vertically elongated basal beam 10 is fastened to each bracket 8 with the ends of the beams 10 projecting upwardly and downwardly past the structural beams 6. Extension arms 12 are secured to each end of the basal beams 10. Guide rail clip assemblies 14 are secured to the extension arms 12, and the guide rail 16 is held in place in the hoistway 2 by the clip assemblies 14.

Figure 2:
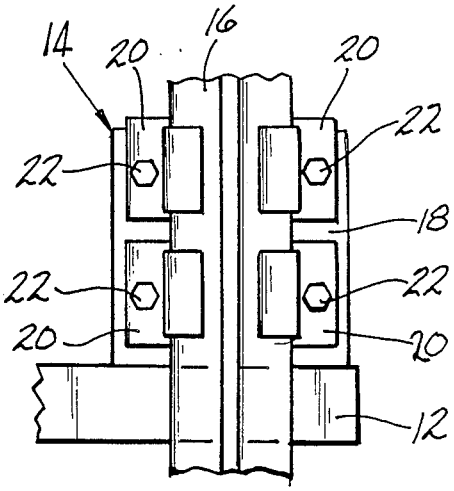
FIG. 2 is a detailed plan view of one of the rail clip assemblies.

Details of a clip assembly 14 are shown in FIG. 2. The clip assembly 14 includes a base plate 18 which is welded to the extension arms 12. There are four generally Z-shaped clips 20 which are secured to the base plate 18 by bolts 22, and which overlap the sides of the rail 16 to hold the latter in place.

Figure 3:
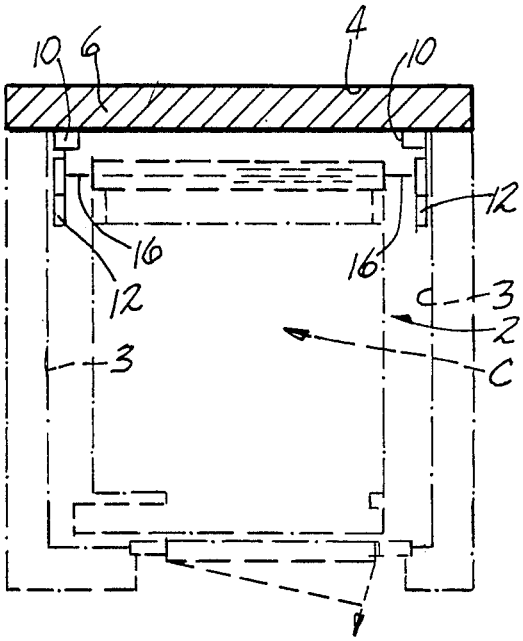
FIG. 3 is a plan view of the hoistway showing the positioning of the rails and mount assemblies relative to the hoistway walls.

Referring to FIG. 3, the relative positions of the assembly in the hoistway 2 are shown. It will be noted that the extension arms 12 are positioned closely adjacent to the side walls 3 proximate the wall 4, the elevator car C (shown in phantom) being cantilever mounted in the hoistway 2.

It will be appreciated that the mounting assembly of this invention allows two sets of guide rail mounting clip assemblies to be used for each horizontal structural beam. This advantage reduces the vertical distance between adjacent rail clips thus stiffening the rails against lateral flexure. The mounting assemblies are of simple construction, strong and yet relatively lightweight and easily installed, as compared to the prior art alternatives. As a result, conventional guide rails can be used with the mounting assembly of this invention.

Since many changes and variations of the disclosed embodiment of the invention may be made without departing from the inventive concept, it is not intended to limit the invention otherwise than as required by the appended claims.

What is claimed is:

1. A mount assembly for elevator guide rails in an elevator hoistway which has spaced apart horizontal building structural beams therein, said mount assembly comprising:

(a) a basal beam connected to each structural beam and extending vertically in the hoistway, said basal beam including upper and lower ends thereof offset upwardly and downwardly of each structural beam respectively;

(b) elongated extension arms mounted on said upper and lower ends of said basal beam, said arms extending horizontally into the hoistway above and below each of the structural beams; and (c) a guide rail mount assembly secured to each of said extension arms at an end thereof distal of said basal beam, said guide rail mount assemblies being operable to clip a guide rail in place in the hoistway, whereby there are at least two guide rail mount assemblies for each guide rail between each of the adjacent structural beams in the hoistway.

2. The mount assembly of claim 1 wherein there are basal beams and extension arms mounted on each of the structural beams adjacent each side wall of the hoistway.

3. The mount assembly of claim 1 wherein the vertical distance between vertically adjacent extension arms is less than the vertical distance between adjacent structural beams in the hoistway.

* * * * *